US005253851A

United States Patent [19]

Fontana

[11] Patent Number: 5,253,851

[45] Date of Patent: Oct. 19, 1993

[54] DEVICE TO OBTAIN A SUPPLEMENTARY SPRINGING EFFECT IN SUPPORTING FRAMES PROVIDED WITH ELASTIC BELTS

[75] Inventor: Anacleto Fontana, Lesmo, Italy

[73] Assignee: Cintel S.r.l., Italy

[21] Appl. No.: 845,386

[22] Filed: Mar. 3, 1992

[30] Foreign Application Priority Data

Apr. 30, 1991 [EP] European Pat. Off. ..... 91830175.5

[51] Int. Cl.[5] ..... F16F 3/00; A47C 23/02

[52] U.S. Cl. ..... 267/103; 267/102; 5/260

[58] Field of Search ..... 267/80, 81, 102, 103, 267/104, 142, 160, 97, 98; 5/231, 260, 263, 474; 297/452, 459

[56] References Cited

U.S. PATENT DOCUMENTS 2,106,066 9/1936 Sadgrove .
2,392,254 1/1946 Mayer ..... 267/102
2,673,598 3/1954 Grattan ..... 267/102
3,057,613 10/1962 Benjamin .
4,231,615 11/1980 Griffiths .
4,407,492 10/1983 Muzzell ..... 267/103

FOREIGN PATENT DOCUMENTS 0015331 3/1979 European Pat. Off. .
820592 4/1937 France .

*Primary Examiner*—Robert J. Oberleitner
*Assistant Examiner*—Chris Schwartz
*Attorney, Agent, or Firm*—Lerner, David, Littenberg, Krumholz & Mentlik

[57] ABSTRACT

In order to provide a springing effect in correspondence with the edge of a belt frame in chairs, sofas or the like, a device is envisaged consisting of a plurality of arms, each fixed to a belt and extending from the latter in inclined position, as well as a common transverse element connecting all the arms. Due to stresses on the latter element, the arms deform the belts which cause a bending moment of elastic return.

6 Claims, 1 Drawing Sheet

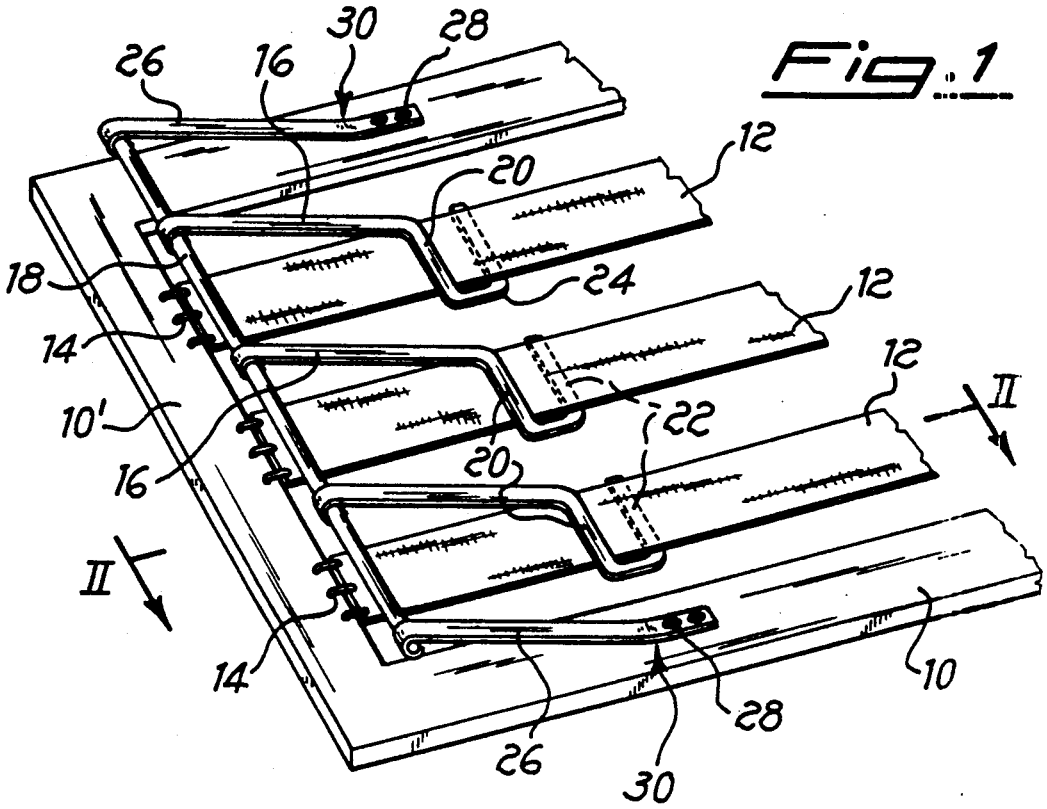
Fig. 1
Fig. 2
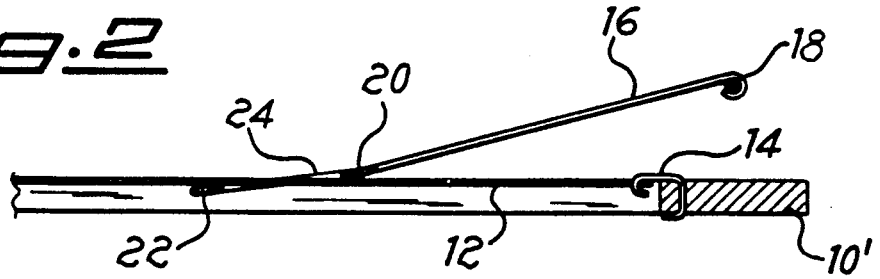
Fig. 3
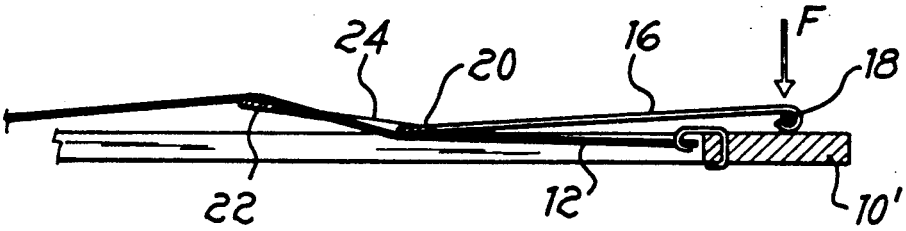

DEVICE TO OBTAIN A SUPPLEMENTARY SPRINGING EFFECT IN SUPPORTING FRAMES PROVIDED WITH ELASTIC BELTS

BACKGROUND OF THE INVENTION

Field of the Invention

This invention relates to a device to obtain a supplementary springing effect in supporting frames provided with elastic belts for application in furniture components, car seats or the like, said springing effect being carried-out parallel to at least one of the frame sides and over its plan, with at least a component perpendicular to the frame itself.

It is known since long time the system of replacing the traditional metal springs with woven elastic belts, which are stretched between opposite elements of rigid frames in order to obtain springing effect in applications of the aforesaid type. Elastic belts have a lot of advantages versus springs, among which longer duration and lower deterioration of the parts in contact with them, and actually their use is more and more widespread replacing springs.

Nevertheless, a limitation of the belt frames consists in the fact that there is no springing effect in correspondence with the frame edges and mainly in correspondence with the front edge of the frame, where in some embodiments a particular support for the sitting person's thighs would be suitable and is in any case required by the market. This particularly occurs in the so-called "classical" furniture components (specially sofas and arm-chairs), wherein in fact springing is still obtained by way of the traditional spiral springs, whose stiffness or length is appropriately increased in correspondence with the front edge just in order to support one's legs.

OBJECTS OF THE INVENTION

An object of the present invention is now that of providing a device of the previously defined type, which may be applied to any belt frame whatever, even possibly already in place, to obtain supplementary springing, specially over one of the frame sides and in correspondence with a supporting area for the user's legs.

For this purpose, the invention envisages a device as mentioned hereinabove and for the aforesaid uses, characterized in that it comprises a plurality of arms each applicable to a belt in a slanting position with respect to the belt itself and capable of elastically reacting to stresses tending to push them parallel to the belt, returning to the initial position when said stresses are over, as well as a transverse element fixable to the free ends of said arms, on which the aforesaid stress can be exerted.

SUMMARY OF THE INVENTION

The different peculiarities and features of the device according to the invention will be now further described with reference to an embodiment, given by way of example and illustrated in the accompanying drawing, wherein:

BRIEF DESCRIPTION OF THE DRAWINGS

FIG. 1 is a perspective view illustrating an example of a device according to the invention, applied to a belt frame; and FIG. 2 and 3 are sectional views as indicated by II—II in FIG. 1, showing the preferred operating ways of the components of the device of FIG. 1.

DESCRIPTION OF THE PREFERRED EMBODIMENTS

With reference first of all to FIG. 1, a normal frame 10, for instance a rectangular wooden frame, is provided with a certain number of belts 12, fastened in whatever proper way (schematized by 14) to two opposite sides of the frame 10, under a tension applied before the fastening, exploiting the elastic properties of the belts themselves. These latter can be applied in any number whatsoever, at fixed or variable reciprocal intervals, and can be also crossed by belts at 90 degrees.

For simplifying the drawing, however, only three parallel and equally spaced belts have been represented, put under tension and hooked to the side 10' of the frame 10 which is supposed to correspond to the front side of the seat.

To obtain the aforesaid springing effect, a device is foreseen whose major components are in the form of arms 16, each of which is fastened to a belt 12 in a way as to extend upwards in a slanting position starting from said belt and reaching, for the foreseen application, a point upward the side 10' of the frame. The uplifted free end of each arm 16 is connected, for instance snapwise, with a common transverse element 18, whose elastic displacements in the direction of the side 10' of the frame 10 therefore involve all the arms 16, compensating the different stresses to which they are submitted.

In order to obtain the desired effect of elastic springing, the arms 16 could present intrinsic elasticity, for example being made of harmonic steel or other appropriate material, at least in correspondence with an area close to the belt.

However, the preferred embodiment exploits for this purpose the elasticity of the belts, envisaging essentially rigid arms 16, which are coupled to each belt by way of two areas or supporting sections, respectively an upper section 20, placed on the side from which extends the arm 16, and a section 22 which engages the belt 12 underneath, namely on the opposite side to that of the arm 16 and in a spaced position along the belt, in opposite direction to the arm 16 with respect to the section 20, as better visible in FIG. 2, the sections 20 and 22 being rigidly connected by a small arm 24. In said conditions, if a force F (FIG. 3) is exerted on the transverse element 18 and consequently on the arms 16, each of the latter exerts a bending moment on the length of the belt 12 between the sections 20 and 22, which causes the belt 12 to bend as visible in FIG. 3; the result is a reaction, due to the belt tension, tending to drive the arm 16 again to its rest position of FIG. 2 and therefore to create the desired springing effect.

Furthermore, this tends to increase the belt 12 tension, improving its functional performance.

As shown in FIG. 1, the transverse element 18 can not only be fastened to the arms 16, but also to the frame 10 by way of other terminal arms 26 which can merely have a driving function, being in this case hinged to the frame 10, or can on their turn exert a springing action, being fixed for instance by riveting in 28 to the frame 10 and being provided with at least an elastically deformable bent area 30.

I claim:

1. A support device for providing resiliency to an article including a frame having a plurality of sides, said support device comprising: belt means having a first end and a second end, and being connected between at least two sides of said frame, said belt means extending in a first plane and having an upper support surface and a lower surface; arm means operatively connected to said belt means to provide resilient support therewith, at least a portion of said arm means extending in a second plane and being connected to said belt means at an intermediate location between said first and second ends so that said second plane extends obliquely with respect to said first plane on a side of said first plane comprising said upper support surface, said arm means including a first member extending generally transverse with respect to said belt means and being arranged to rest on said lower surface of said belt means and a second member extending generally transverse with respect to said belt means and being arranged to rest on said upper support surface of said belt means, and connecting means for connecting said first and second members, said first and second members arranged at spaced locations along said first plane, at least a portion of said belt means and said arm means being adapted to be temporarily displaced from said first and second planes respectively upon application of a force to said arm means, said force having a component perpendicular to said first plane, whereby a counter force to said perpendicular component is produced as a result of said operative connection between said belt means and said arm means, said counter force acting to return said belt means and said arm means to said respective first and second planes.

2. The support device of claim 1 wherein said arm means and said belt means comprise resilient materials.

3. The support device of claim 1 wherein said arm means comprises a plurality of elongated arm members, and said belt means comprises a plurality of belts, each of said plurality of elongated arm members arranged on a respective one of said plurality of belts.

4. The support device of claim 3 including a transverse member connected to each of said plurality of elongated arm members, said transverse member extending in a third plane parallel to said first plane.

5. The support device of claim 4 including a pair of elongated end arms, each of said elongated end arms having a first end and a second end, said first ends being connected to respective opposing sides of said frame and said second ends being connected to said transverse member.

6. The support device of claim 3 wherein each of said elongated arm members includes a generally C-shaped portion and a generally straight portion, said generally straight portion extending in said second plane, said C-shaped portion comprising said first and second members of said elongated arm members.

* * * * *